United States Patent [19]

Ceppo

[11] 4,252,314

[45] Feb. 24, 1981

[54] DEVICE FOR PERFORMING WEIGHT-LIFTING EXERCISES

[76] Inventor: Louis Ceppo, 2712 Sipp Ave., Medford, N.Y. 11763

[21] Appl. No.: 108,640

[22] Filed: Dec. 31, 1979

[51] Int. Cl.[3] ..... A63B 21/06

[52] U.S. Cl. ..... 272/117; 272/144; 272/123; 272/143; 272/134

[58] Field of Search ..... 272/93, 118, 134, 143, 272/119, 144, 123, 117; 128/25 R

[56] References Cited

U.S. PATENT DOCUMENTS

| | | | |
|---|---|---|---|
| Re. 26,606 | 6/1969 | Dodge | 272/117 X |
| 3,117,782 | 1/1964 | Johnston | 272/134 X |
| 3,834,694 | 9/1974 | Pridgen | 272/118 |
| 4,084,815 | 4/1978 | Flannery | 272/143 X |

FOREIGN PATENT DOCUMENTS

| | | | |
|---|---|---|---|
| 1183144 | 1/1959 | France | 272/117 |
| 1447999 | 6/1966 | France | 272/123 |

*Primary Examiner*—William R. Browne
*Attorney, Agent, or Firm*—Bauer & Amer

[57] ABSTRACT

A weight-lifting exercise device which combines, in a unique manner, the operational modes of a bench press and lat machine, so that the exerciser can lift simultaneously with his upper torso and with his legs. The within device can thus advantageously be used in performing a solo, or unattended, forced repetition, in complete safety, as well as a wide range of other weight-lifting exercises.

3 Claims, 5 Drawing Figures

DEVICE FOR PERFORMING WEIGHT-LIFTING EXERCISES

The present invention relates generally to an improved weight-lifting exercise device, wherein more particularly, the improvements contribute to the versatility or variety of weight-lifting exercises capable of being performed thereon.

To exemplify but one, albeit important, respect in which the operational mode of the within inventive device is a noteworthy contribution to prior art or presently known weight-lifting exercise devices, it is to be noted that an exerciser can safely perform thereon a forced repetition, popularly called a "forced rep". As understood, this exercise calls for the repetitious lifting of an exercise weight intentionally selected to just slightly exceed what is believed to be the lifting ability of the exerciser, so that a third party or "spotter" must assist in a nominal way the completion of the lift during the last one or two repetitions. The operational mode of the within exercise device permits the exerciser to obtain all of the benefits of "forced rep" weight-lifting exercises, but without any "spotter", and without any danger of personal injury which otherwise might occur from an unmanageable weight if this difficult exercise cannot be physically completed.

Broadly, it is an object of the present invention to provide an improved weight-lifting exercise device of enhanced versatility, and otherwise overcoming limitations and shortcomings of the prior art. More particularly, it is an object to provide a device permitting repetitious weight-lifting exercises wherein the total physical resources of the exeriser, i.e. his arms or upper torso, and also his legs, can be simultaneously occupied in the exercise. Such total involvement enables a solo, or unattended, performance of a "forced rep", all as is hereinafter described in detail, as well as contributing to other noteworthy and beneficial uses of the within inventive exercise device.

A device for performing weight-lifting exercises while in a prone position demonstrating objects and advantages of the present invention includes means defining a weight-lifting station having an operative location adjacent the arms of the prone-positioned exerciser. The referred to station consists of a cooperating pair of spaced apart uprights that are used to mount a selected exercise weight for ascending movement from a defined starting position to an elevated clearance position along said uprights, and thus is similar to a prior art bench press. Cooperating therewith is a pulling cable operatively arranged to extend in overhead spanning relation from an end connected to the exercise weight to an operative position for the opposite cable end that is located adjacent the feet of the prone-positioned exerciser. Foot stirrup means are provided on said opposite cable end and, preparatory to exercising use of the device, are adapted to be engaged by the feet of the exerciser. In this way, the exercise weight is adapted to be lifted by the arms of the exerciser assisted by pulling force exerted on said cable by his feet. In effect, therefore, the lifting forces of the exerciser's feet substitutes for the nominal assistance heretofore provided by a "spotter" during performance of a "forced rep".

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
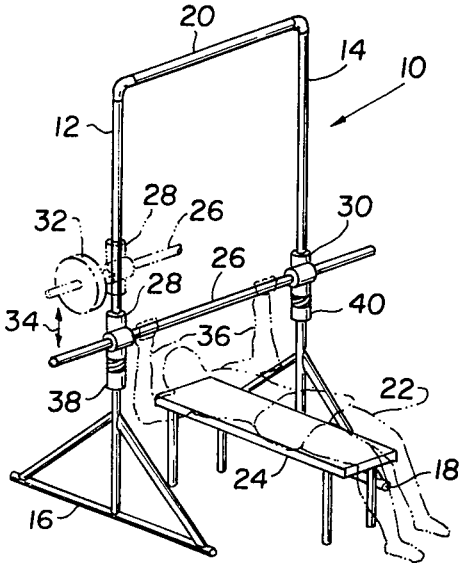
Fig.1 PRIOR ART
FIG. 1 is a perspective view of a prior art device for performing bench press exercises.
Figure 2:
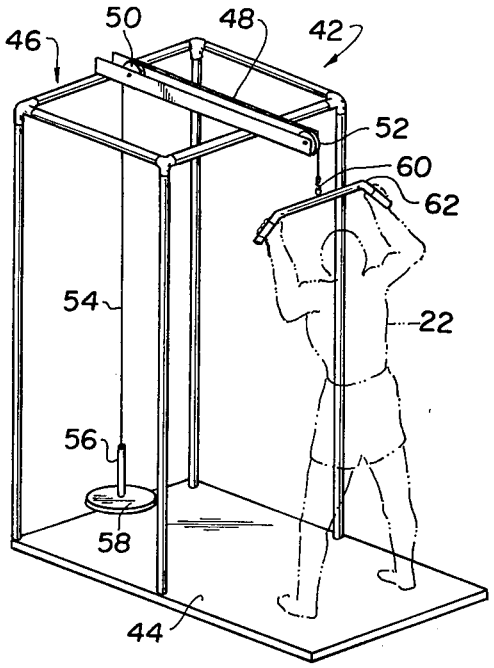
Fig.2 PRIOR ART
FIG. 2 is a perspective view also of a prior art so-called lat machine also used for performing weight-lifting exercises.
Figure 3:
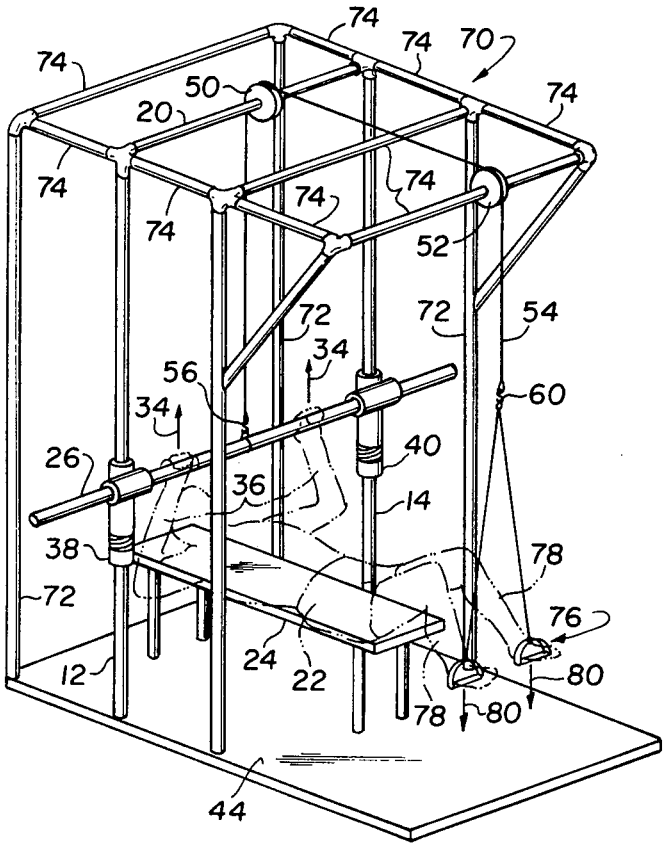
Figure 4A:
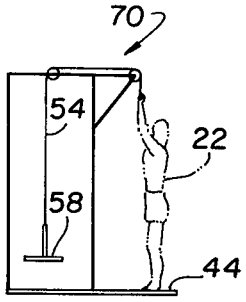
Figure 4B:
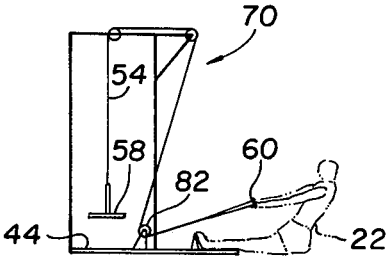

FIG. 3 is a perspective view of the within inventive device for performing weight-lifting exercises that in operational mode is a unique combination of the prior art devices of FIGS. 1 and 2; and Remaining FIGS. 4A and 4B are simplified side elevational views, on a reduced scale, illustrating additional exercise routines that may be performed using the inventive combination exercise device of FIG. 3.

As understood, so-called bench presses or weight lifting exercises are readily performed using a bench press device, generally designated 10, operated and constructed as illustrated in FIG. 1. More particularly, device 10 is of the type having two upright members 12 and 14 held in their respective vertical orientation by appropriate bases 16 and 18 and a cross-piece 20 connected in spanning relation across the top of the uprights 12 and 14.

Use of the bench press 10 contemplates exerciser 22 assuming a prone position, as illustrated, on a bench 24 which advantageously locates the arms of the exerciser beneath a weight bar 26 appropriately affixed, as by welding or the like, to cylindrical members 28 and 30 mounted for sliding movement on the uprights 12 and 14. Omitted from the full line perspective of FIG. 1 are the selected exercise weights, shown in the phantom perspective thereof and designated 32, which are appropriately mounted on opposite ends of the weight bar 26. As understood, the weight-lifting exercises are performed by the exerciser 22 forcing the weight bar in ascending movement 34 using his arms 36, said ascending movement of the weight bar 26 and weights 32 being along the vertical path defined by the uprights 12 and 14. For completeness' sake, it should be noted that the starting position for the weight bar 26 in relation to the uprights 12 and 14 is determined by adjustable stops 38 and 40 of well known construction. That is, stops 38 and 40 support the weight bar 26 and the exercise weights 32 in the full line starting position as illustrated, from which position the exerciser 22 "presses" the weights in ascending movement 34 to an elevated position, then controls the descent thereof against the stops 38, 40, and makes a selected number of repetitions of these alternating ascending and descending movements in accordance with his weight-lifting exercise routine.

At this point in the description wherein reference has been made to the fact that repetition is a normal part of the performance of weight-liftint exercises, it is helpful to note that two aspects thereof are generally believed to be critical and most beneficial to muscle development, strength and growth. The first is the number of times that the exercise is repeated in any exercise session. The second is the weight that is used during the exercise. For present purposes, it suffices to note that among those who advocate weight lifting as a means of promoting muscle growth and development there is a belief that the greatest benefit is obtained if the exerciser forces himself to lift an exercise weight believed to be beyond his physical capacity. One forced repetition of such an exercise weight is believed by many to be more beneficial, at least in terms of muscle growth and development, than numerous repetitions using weights well within the lifting capacity of the exerciser. Thus, it is of particular importance to perform a forced repetition as above defined, more popularly referred to as a "forced rep".

As will be described in greater detail subsequently, the within inventive device, as constructed and shown in FIG. 3, is particularly advantageously used in allowing an exerciser to perform a "forced rep", without any third party assistance and yet with complete safety, if it should turn out that the exerciser cannot actually physically complete the "forced rep".

Before referring to FIG. 3 and proceeding with a detailed description of the within inventive exercise device, reference is first made to FIG. 2 which illustrates a prior art so-called lat machine, generally designated 42 in said figure. Exercise machine or device 42 includes a base 44 on which there is a grid supporting structure 46 which provides overhead support to a bracket 48 having journalled at opposite ends a pair of pulleys 50 and 52. Entrained over the pulleys 50, 52 is a cable 54 connected at one end, as at 56, to an exercise weight 58 and connected at its opposite end 60 to a handlebar 62. As understood, use of the lat machine 42 contemplates that the exerciser 22 pull down on the bar 62 and thus exert a pulling force on the cable 54 which lifts the exercise weight 58. The pertinency of the lat machine 42 to the within invention is that the operational mode thereof, as will be apparent as the description proceeds, is utilized to advantage in the operational mode of the within inventive device of FIG. 3 insofar as it facilitates the performance of a "forced rep" during exercise service or use of said FIG. 3 device.

Referring now to FIG. 3, the within inventive device hereof, generally designated 70 in this figure, includes a number of structural features, but in a unique combination, that have already been described in connection with the prior art devices of FIGS. 1 and 2. These similar structural features will therefore be designated by the same reference numerals used in connection with FIGS. 1 and 2. More particularly, device 70 also includes the panel 44 which serves as a base for uprights 12 and 14 which essentially serve the same function as the uprights in the bench press of FIG. 1. In device 70 there is also provided additional uprights, individually and collectively designated 72, which together with additional horizontally oriented structural members, individually and collectively designated 74, cooperate to form an upright grid structure somewhat similar to the grid structure 46 of the previously described lat machine 42. A somewhat noteworthy structural feature worth particularly noting, however, is that the crosspiece 20 which connects and thus supplies structural rigidity to the uprights 12 and 14 used for the exercise weights, also advantageously mounts one of the pulleys 50, the other pulley 52 being mounted and aligned in spaced relation thereto on a remotely located crosspiece 74. Entrained over the pulleys 50 and 52 is the cable 54 which in the environment illustrated in FIG. 3 is connected at one end, as at 56, to the weight bar 26 and at its opposite end 60 is connected to foot stirrup means 76. Thus in accordance with the present invention, cable 54 is supported in spanning and overhead relation to the exerciser 22 when occupying a prone position on bench 24 and this locates end 60 thereof, and thus positions the foot stirrup means 76 adjacent the exerciser's legs 78, all as is clearly illustrated in FIG. 3.

As a result of the construction of device 70, as just described, the device is particularly appropriate for performing a "forced rep" in complete safety. More particularly, it is contemplated that the exercise 22 will assume a prone position on the bench 24 with his arms located beneath and adjacent the weight bar 26. In this prone position the exerciser can also readily fit his feet within the cable stirrup means 76. Assuming that exercise weights are positioned on the weight bar 26, exerciser 22 then performs his exercise routine by pushing his arms up on the exercise bar 26 thus urging it through ascending movement 34. Simultaneously with this effort being exerted with his arms 36, the exerciser also forces down with his feet 78, thus applying with a descending stroke 80 a pulling force on the cable 54 to assist the exerciser in his lift or press of the exercise weights on the bar 26. In effect, therefore, exerciser 22 is performing a "forced rep" with his feet 78, rather than with a third party providing the additional assistance required to lift an exercise weight that is selected to be slightly greater than that which the exerciser believes he can lift using only his arms or upper torso.

It is further important to note that any solo "forced rep" performed using the within inventive device 70 is without danger of injury to the exerciser 22 since the stops 38 and 40 on their respective cooperating uprights 12 and 14 limit the descent of any uncontrolled exercise weight to the clearance position above the exerciser as illustrated in FIG. 3.

Illustrated in simplified form in FIG. 4A is device 70 set up for use as a lat machine. In such use bench 24 is removed and weight 58 attached to one end of cable 54 so that it can be used in performing exercises by the exerciser 22 alternately pulling down and releasing the other end of the cable.

In the similarly simplified illustration of FIG. 4B it is also demonstrated that the device 70 can be arranged for rowing exercises. In this instance, an additional pulley 82 is attached to the base 44 and the exerciser 22 assumes a sitting or rowing position from which he alternately raises and lowers the exercise weight 58 by correspondingly manipulating the cable end 60.

From the foregoing description it should be readily appreciated that the within inventive device 70 is adapted, both by its construction and operational mode, to permit a wide range of weight-lifting exercises. Most important, however, and as has been described in detail in connection with FIG. 3, device 70 hereof permits the exerciser to in effect assist himself in performing a "forced rep" which heretofore required the assistance of a third party or "spotter" in order, firstly, to provide the additional physical assistance to permit the lifting of the exercise weight and, secondly, to make sure that during the attempt to perform a "forced rep" that the exerciser is protected against injury that otherwise would result from an uncontrolled weight in the event that this exercise is not successfully performed.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A device for performing weight-lifting exercises while in a prone position, said device comprising means defining a weight-lifting station having an operative location adjacent the arms of the prone-positioned exerciser, said station consisting of a cooperating pair of spaced apart uprights for mounting a selected exercise weight for ascending movement from a defined starting position to an elevated clearance position along said uprights, a pulling cable operatively arranged to extend in overhead spanning relation from an end connected to said exercise weight to an operative position for said opposite cable end located adjacent the feet of said prone-positioned exerciser, and foot stirrup means on said opposite cable end adapted to be engaged by said exerciser during exercising use of said device, whereby said exercise weight is adapted to be lifted by the arms of said exerciser assisted by pulling force exerted on said cable by his feet.

2. A weight-lifting exercise device as claimed in claim 1, including a bench for providing elevated support to said prone-positioned exerciser to thereby facilitate said exerciser urging said cable in a downward stroke simultaneously with his arm-lifting effort applied to said exercise weight.

3. A weight-lifting exercise device as claimed in claim 2, wherein the overhead support for said cable includes a pulley rotatably disposed on a shaft advantageously connected in spanning relation between said uprights such that said uprights both define the movement path for said exercise weight and assist in providing support for said cable.

* * * * *